United States Patent [19]

Harris

[11] Patent Number: 5,016,438

[45] Date of Patent: May 21, 1991

[54] EMISSION CONTROL APPARATUS

[75] Inventor: Harold L. Harris, Houston, Tex.

[73] Assignee: Harris International Sales Corporation, Houston, Tex.

[21] Appl. No.: 411,818

[22] Filed: Sep. 25, 1989

[51] Int. Cl.[5] ..... F01N 3/28

[52] U.S. Cl. ..... 60/299; 422/176; 422/177; 422/180

[58] Field of Search ..... 60/299; 422/176, 177, 422/180

[56] References Cited

U.S. PATENT DOCUMENTS 2,288,943 7/1942 Eastman ..... 60/299
3,180,712 4/1965 Hamblin ..... 422/173
3,445,196 5/1969 Thomas ..... 422/180
4,601,168 7/1986 Harris ..... 422/180

*Primary Examiner*—Douglas Hart
*Attorney, Agent, or Firm*—Bill B. Berryhill

[57] ABSTRACT

Improved emission control apparatus for use with an internal combustion engine having a housing with an inlet and outlet, the outlet being connected to the exhaust of the engine. Mounted in the housing at spaced locations are first and second catalytic cells through which the engine exhaust gases pass for conversion to less noxious compounds. Some of the gases passing through the first catalytic cell are returned upstream thereof for recirculation through said first catalytic cell. All of the gases pass through the second catalytic cell.

27 Claims, 2 Drawing Sheets

EMISSION CONTROL APPARATUS

BACKGROUND OF THE INVENTION

1. Field of the Invention

The present invention pertains to apparatus for use with internal combustion engines to reduce noxious gases emitted therefrom. In particular, the present invention pertains to apparatus particularly suitable for use with natural gas fueled engines and for converting nitrogen oxides, carbon monoxides and unburned hydrocarbons from the exhaust of such engines to less noxious compounds and for reducing the noise emitted therefrom.

2. Brief Description of the Prior Art

Silencers or mufflers for internal combustion engines have existed for many years. Most industrial silencers utilize some type of housing in which is mounted various types of baffles or other silencing components for reducing the noise produced at the exhaust of an internal combustion engine.

In addition to noise reduction, a great deal of attention has also been directed, in recent years, to reducing the noxious gases emitted from the exhaust of an internal combustion engine, e.g. nitrogen oxide, carbon monoxide and other unburned hydrocarbons. As interest and concern about pollution of the atmosphere increases, the search continues for effective means for reducing these noxious emissions. Increased regulation by state and federal authorities mandates that more effective means be found. The most effective means of reducing noxious emissions at this time appears to be those methods which utilize some type of catalyst which converts the noxious gases to water, nitrogen, carbon dioxide and other harmless emissions.

Most exhaust emission control apparatus of the prior art utilizes separate devices for noise reduction and noxious gas reduction. This is probably due to the fact that silencers or mufflers are commonly made by one manufacturer and catalytic converters by another. Since these devices are made separately but must be connected in series to an engine exhaust, the pressure drop therethrough is relatively great, resulting in decreased fuel efficiency. In addition to increased operating expense, two separate units usually result in greater installation and maintenance costs. In recent years, some emission control apparatus have been manufactured which combine the functions of noise reduction and noxious gas reduction in a single device or apparatus. Examples may be seen in U.S. Pat. Nos. 4,209,493 and 4,601,168. While these devices are substantially more efficient and cost effective than those of the prior art, continued concern over noise and air pollution dictates even more efficient and effective apparatus.

SUMMARY OF THE INVENTION

The present invention provides combination noise and emission control apparatus for use with an internal combustion engine of the type having an enclosed housing with an inlet at one end thereof for connection with the exhaust of an engine and an outlet at the opposite end thereof for discharge to the atmosphere. Mounted in the housing are catalytic converter components for reducing noxious gases emitted from the engine by converting nitrogen oxides, carbon monoxides and unburned hydrocarbons to less noxious compounds. Also mounted in the housing are noise reduction components for reducing the noise emitted from the engine.

The catalytic converter components of the present invention are unique in that two catalytic cells are transversely disposed in the housing at spaced intervals or distances. At least part of the engine exhaust passes through the first catalytic cell prior to passage through the second catalytic cell and all of the engine exhaust passes through one or both of the catalytic cells prior to being discharged from the housing outlet. Although these catalytic cells provide a boundary between various chambers and the housing, return areas are provided which allows some of the engine exhaust passing through the first catalytic cell to return upstream thereof for recirculation through the first catalytic cell. However, there are no return areas around the second catalytic cell and all of the exhaust gases must pass therethrough.

The noise reduction components include a number of tubular devices which are either coaxially aligned with the housing axis or which are parallel thereto. The walls of these tubular components are typically perforated by a plurality of holes allowing free flow of gas therethrough. Several arrangements are disclosed including one for industrial silencing and another for residential quality silencing.

The combination noise and emission control apparatus of the present invention provides noise and gas emission control in a single housing so that some of the parts which are normally duplicated in systems utilizing separate noise and gas emission control devices are combined for common usage. This results in reduced installation and maintenance costs. Furthermore, pressure drop through the emission control of the present apparatus is much less than those which utilize separate noise and gas emission control apparatus. This results in substantial fuel savings. Most importantly, noise abatement and noxious gas emission reduction is enhanced and made more effective with the apparatus of the present invention. Many other objects and advantages of the invention will be apparent from reading the description which follows in conjunction with the accompanying drawings.

DESCRIPTION OF PREFERRED EMBODIMENTS

Figure 2:
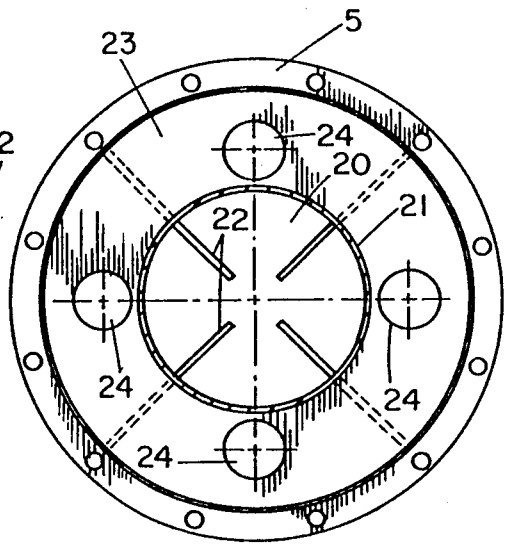
FIG. 2 is a cross-sectional view of the combination noise and emission control apparatus of FIG. 1, taken along lines 2—2 thereof.
Figure 1:
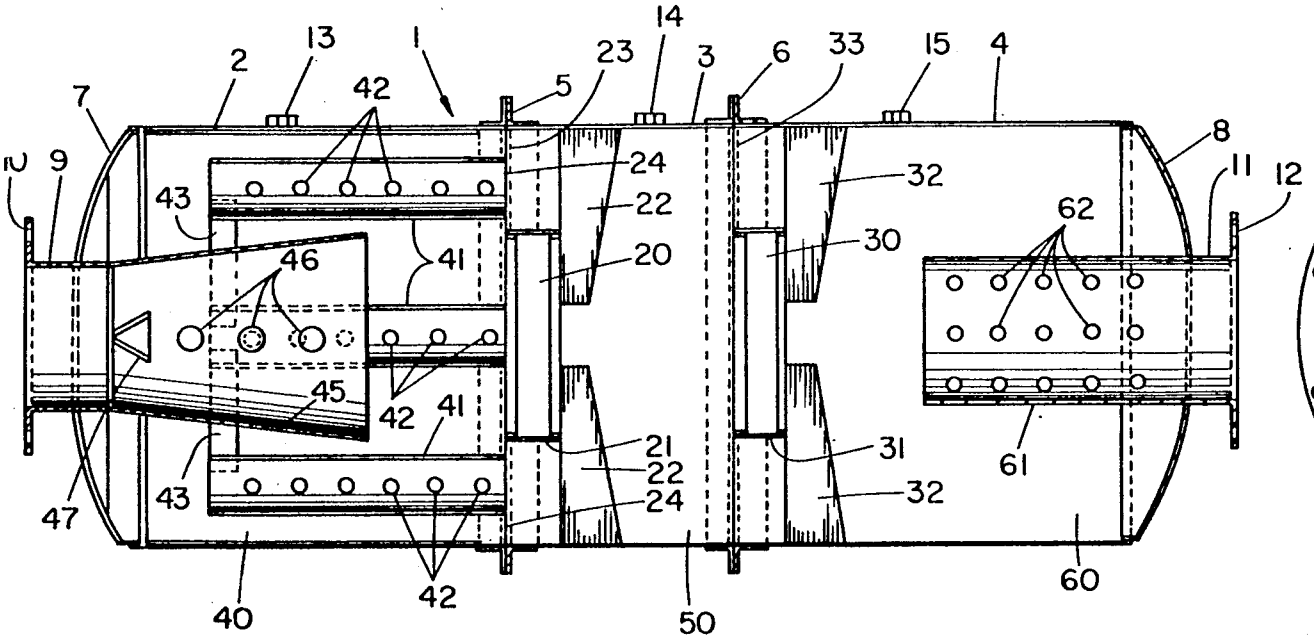
FIG. 1 is a longitudinal view, in section, of combination noise and emission control apparatus according to a preferred embodiment of the invention.

Referring first to FIGS. 1 and 2, there is shown combination noise and emission control apparatus which includes a cylindrical housing 1 which may actually be made of three cylindrical sections 2, 3, 4 joined at support rings 5 and 6 by bolting, welding or any other suitable method and closed at opposite ends by heads 7 and 8. The head 7 is provided with an inlet 9 surrounding which is a flange 10 by which the apparatus may be connected to the exhaust (not shown) of an internal combustion engine (not shown). The opposite head 8 is provided with an outlet 11 surrounding which is a flange 12. The flange 12 may be connected to a discharge pipe (not shown) for discharge into the atmosphere or for additional handling. Sample ports such as 13, 14 and 15 may be provided for sensing temperature, pressure, gas analysis, etc.

Transversely disposed in the housing 1 at fixed distances from the housing inlet 9 is a first catalytic cell 20 and, downstream thereof, a second catalytic cell 30. These catalytic cells 20, 30 are normally made of metallic substances and compounds which are effective in converting nitrogen oxide, carbon monoxide and other unburned hydrocarbons to nitrogen, carbon dioxide, water and other harmless products. The cells 20, 30 illustrated in FIGS. 1 and 2 are cylindrical cells coaxially aligned with the axis x—x of the cylindrical housing 1. Each catalytic cell 20, 30 may be surrounded and held in place by a cylindrical containment chamber 21, 31. Each of these chambers 21, 31 may be centrally supported in the housing 1 by a plurality of radial support members 22, 32 which are welded or bolted to the inside walls of the housing 1. These containment chambers 21, 31 also support the cells 20, 30 against stress and pressure from backfire explosions and other occurrences.

It should be noted that surrounding each catalytic cell 20, 30 is an annular wall or partition 23, 33. Thus it can be said that the housing 1 is divided into three chambers: an inlet chamber 40, an intermediate chamber 50 and outlet chamber 60.

As will be noted from the drawings, the annular wall 23 surrounding the first catalytic cell 20 is provided with a plurality of ports or passageways 24. Connected to each of these ports 24 and extending toward the inlet end of the housing 1 is a plurality of tubular members 41, one for each port 24. These tubular members 41 terminate at some distance from the inlet head 7 and open into the inlet chamber 40. In addition, the walls of each of the tubular members 41 are perforated by holes 42 which allow exhaust gases to freely enter and exit the tubular members 41 therethrough. Structural support members 43 may aid in supporting the open or free ends of the tubular members 41. These tubular members 41 are sometimes referred to as internal connector silencing tubes and serve functions for both noise reduction and noxious gas conversion that will be more fully understood hereafter.

Centrally supported in the inlet chamber 40 is an inlet silencer/diffuser tube 45 one end of which is connected to the inlet 9 and the opposite end of which terminates somewhere near the midsection of the inlet chamber 40. The walls of the silencer/diffuser tube 45 maybe perforated with a plurality of holes 46 and may be flared outwardly from the inlet 9 toward the first catalytic cell 20. A conical diffuser 47 may be centrally disposed within the throat of the silencer/diffuser tube. The diffuser 47 and the flared shape of the silencer/diffuser tube 45 aides in diffusing and distributing exhaust gases across the catalytic cell 20.

Attached to the outlet 11 and extending in a direction toward the second catalytic cell 30 is an outlet tube 61. The walls of the outlet tube 61 are perforated by a plurality of holes 62 allowing gases to enter and exit said tube therethrough.

In operation, exhaust gases from an internal combustion engine with which the apparatus of the present invention is used, first flow through the inlet 9 and silencer/diffuser tube 45 for relatively even distribution into the inlet chamber 20. From the inlet chamber 20, at least a portion of these exhaust gases pass through the catalytic cell 20 for conversion into less noxious gases. Some of the gases entering the intermediate chamber 50 return through the ports 24 and the silencing tubes 41 for reentry into the inlet chamber 40. They are then recirculated through the first catalytic cell 20. All of the gases eventually exit from the intermediate chamber 50 through the second catalytic cell 30 into the outlet chamber 60. Further conversion of the noxious gases occur through the catalytic cell 30 and the less noxious gases and compounds eventually exit the apparatus through the outlet tube 61 and outlet 11. It will be noted that there are no ports or return passages surrounding the second catalytic cell 30 so that all of the gases entering the outlet chamber 60 must exit through the outlet 11.

The operational theory of providing dual catalyst cells is that dual catalyst cells provide more exposure surface for gas flow. In addition, the return ports provided through the wall 23 surrounding the first catalytic cell 20 permits recirculation of some of the exhaust gases through the first catalytic cell. In addition, the inlet chamber 40, intermediate chamber 50 and the silencer/diffuser tubes 41 act in combination to suppress and reduce surges through the apparatus resulting in the exhaust gases being in residence longer over a greater catalyst surface. These features, along with the concomitant reduction of gas velocity, provide a greater time of residence for the gases. This results in substantially greater efficiency and performance with as much as seventy percent (70%) greater emissions reduction than other designs. Furthermore, the components of the apparatus, particularly the diffuser 47, inlet silencer/diffuser tube 45, silencing tubes 41 and outlet tube 61 result in substantial noise reduction making the apparatus especially acceptable for industrial noise silencing and/or abatement.

Figure 3:
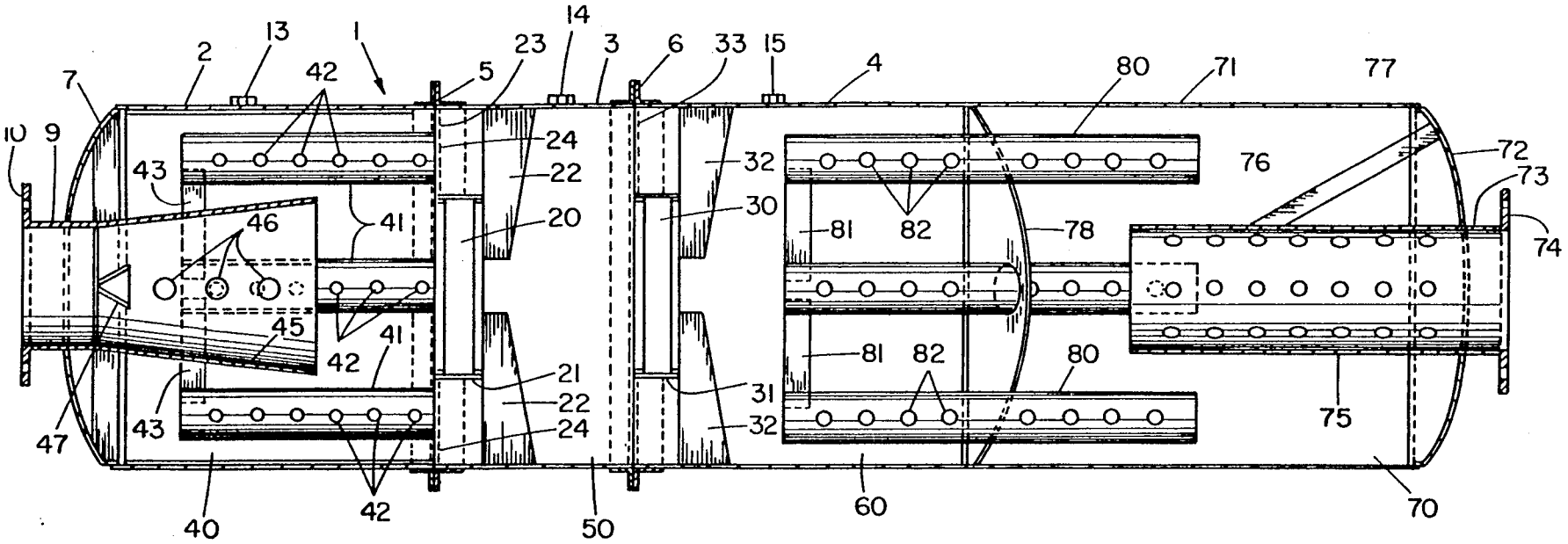
FIG. 3 is a longitudinal view, in section, of combination noise and emission control apparatus according to another preferred embodiment of the invention.

Referring now to FIG. 3, an alternate embodiment of the invention will be described which provides even greater noise reduction than the embodiment of FIGS. 1 and 2. Many of the components of the embodiment of FIG. 3 are similar or identical to the embodiment of FIGS. 1 and 2. These components will be designated by the same reference numerals and many of them will not be redescribed. In fact, the embodiment of FIGS. 1 and 2 may be easily modified to provide the embodiment of FIG. 3. As shown, all of the components of the apparatus of FIG. 3 from the inlet flange 10 to the cylindrical housing section 4 may be identical to the embodiment of FIGS. 1 and 2. At this point, an additional cylindrical section 71 may be added and provided with a head 72, outlet 73 and surrounding flange 74. An outlet tube 75, similar to the outlet tube 61 of FIG. 1 except that it is perhaps longer, is also provided with perforated holes 76. Additional bracing 77 may be required.

A dividing wall 78, much like the head 8 of the apparatus of FIG. 1, is provided to separate what was the outlet chamber 60 (now another intermediate chamber) from a new outlet chamber 70. The chamber 60 and the outlet chamber 70 are in fluid communication with each other through a plurality (four in the exemplary embodiment) of baffle tubes 80. The baffle tubes 80 are open at both ends and extend to somewhat a midpoint of chambers 60 and 70, respectively. Support braces 81 may be provided to maintain the parallel disposition of the baffle tubes 80. The walls of the baffle tubes 80 may be perforated by a plurality of holes 82. The perforated baffle tubes 80 and the lengthened outlet tube 75 serve to further reduce noise emitted from the engine to which the apparatus is attached.

Operation of the apparatus of FIG. 3 is essentially the same as the apparatus of FIGS. 1 and 2, the noxious gases passing through the dual catalyst cells 20, 30 eventually into the chamber 60. From the chamber 60, the less noxious gases and compounds which are converted by the catalytic cells 20, 30 pass through the baffle tubes 80 into the outlet chamber 70 and eventually exit the apparatus through the outlet tube 75. While the conversion of noxious gases is substantially the same in the embodiment of FIG. 3 as in the embodiment of FIGS. 1 and 2, the noise reduction characteristics thereof are substantially better. In fact, tests have indicated that this embodiment meets noise abatement requirements in many residential environments.

Thus, the combination noise and emission control apparatus of the present invention provides apparatus of greater efficiency and effectiveness than apparatus of the prior art. Its design results in highly competitive manufacturing and maintenance costs and more importantly results in cost savings in fuel consumption due to less pressure drop than designs of the prior art. Most importantly, the apparatus of the present invention results in much improved, efficient reduction of air and noise pollution.

While two preferred embodiments of the present invention have been described herein, many other variations can be made without departing from the spirit of the invention. Thus, it is intended that the scope of the invention be limited only by the claims which follow.

I claim:

1. Improved emission control apparatus for use with an internal combustion engine, said apparatus having an enclosed cylindrical housing with an inlet at one end thereof for connection with the exhaust of said engine and an outlet at the opposite end thereof; converter means being mounted in said housing for reducing noxious gases emitted from said engine by converting nitrogen oxides, carbon monoxides and unburned hydrocarbons to less noxious compounds for discharge through said outlet, wherein said converter means comprises: a first catalytic cell transversely disposed in said cylindrical housing at a fixed distance from said housing inlet and a second catalytic cell transversely disposed in said cylindrical housing at a fixed distance from said first catalytic cell, the cross-sectional area of said first catalytic cell being less than the cross-sectional area of said cylindrical housing leaving one or more return areas which allow at least some of said engine exhaust passing through said first catalytic cell to return through said return areas for recirculation through said first catalytic cell, all of said engine exhaust passing through said second catalytic cell prior to discharge through said outlet.

2. Improved emission control apparatus as set forth in claim 1 in which said first catalytic cell is circular in cross-section and is coaxially mounted on the axis of said cylindrical housing, said return areas being provided by a plurality of ports radially disposed around said axis between the outside diameter of said first catalytic cell and the inside diameter of said cylindrical housing.

3. Improved emission control apparatus as set forth in claim 2 including a plurality of tubular members, one for each of said ports, extending from said ports toward said inlet and through which some of said engine exhaust which passes through said first catalytic cell may return for said recirculation through said first catalytic cell.

4. Improved emission control apparatus as set forth in claim 3 in which the walls of said tubular members are perforated by a plurality of holes allowing some of said engine exhaust to enter or exit said tubular members therethrough.

5. Improved emission control apparatus as set forth in claim 1 including noise reduction means mounted in said housing for reducing the noise emitted from said engine, said noise reduction means including at least one tubular member in fluid communication with said housing inlet and opening toward said first catalytic cell.

6. Improved emission control apparatus as set forth in claim 5 in which said noise reduction means comprises a second tubular member one end of which receives the converted exhaust gases leaving said second catalytic cell and the opposite end of which is attached to said housing outlet so that said converted exhaust gases may be discharged therethrough.

7. Improved emission control apparatus as set forth in claim 6 in which the wall of at least one of said tubular members is perforated to allow circulation of exhaust gases therethrough.

8. Improved emission control apparatus as set forth in claim 6 in which a plurality of smaller tubular members whose axes are parallel to the central axis of said housing are disposed about one end of said housing opening into an area downstream of said first catalytic cell and providing return passages which allow at least some of said engine exhaust which passes through said first catalytic cell to return upstream of said first catalytic cell for recirculation therethrough.

9. Improved emission control apparatus as set forth in claim 1 in which said first and second catalytic cells are of substantially the same cross-sectional flow area, the area between the outside perimeter of said second catalytic cell and the inside diameter of said housing being closed so that all of said engine exhaust is directed through said second catalytic cell for passage into an outlet chamber and exit through said housing outlet.

10. Improved emission control apparatus as set forth in claim 9 including one or more tubular members, one for each of said ports, which extend from said ports toward said one end of said housing and through which said returning exhaust gases may pass for said recirculation through said first catalytic cell.

11. Improved emission control apparatus as set forth in claim 10 in which the walls of said one or more tubular members are perforated by holes allowing exhaust gases to enter and exit said tubular members therethrough.

12. Improved emission control apparatus as set forth in claim 11 including an inlet tube connected at one end to said inlet and the opposite end of which opens toward said first catalytic cell.

13. Improved emission control apparatus as set forth in claim 12 in which said inlet tube is frustoconical the diameter thereof increasing from said inlet toward said first catalytic cell.

14. Improved emission control apparatus as set forth in claim 12 including an outlet tube connected at one end to said outlet and the opposite end of which is open to receive converted gases passing through said second catalytic cell.

15. Improved emission control apparatus as set forth in claim 14 in which the walls of at least one of said inlet and outlet tubes is perforated by a plurality of holes allowing gases to enter and exit said tubes therethrough.

16. Improved emission control apparatus as set forth in claim 1 including noise reduction means mounted in said housing for reducing noise emitted from said engine, said noise reduction means including a plurality of perforated tubular members upstream of said first catalytic cell and a plurality of perforated tubular members downstream of said second catalytic cell and through which said exhaust gases may pass.

17. Improved emission control apparatus for use with an internal combustion engine, said apparatus having an enclosed housing at one end of which is an inlet for connection with the exhaust of said engine and at the opposite end of which is an outlet, converter means being mounted in said housing for reducing noxious gases emitted from said engine by converting nitrogen oxides, carbon monoxides and unburned hydrocarbons to less noxious compounds for discharge through said outlet, wherein the improvement comprises:

a first catalytic cell transversely disposed in said housing separating an inlet chamber thereof from a downstream intermediate chamber and through which at least some of said engine exhaust gases pass;

a second catalytic cell transversely disposed in said housing separating said intermediate chamber from another chamber downstream thereof and through which all of said engine exhaust gases pass prior to discharge through said outlet; and return means providing fluid communication between said inlet chamber and said intermediate chamber to allow at least a portion of the exhaust gases passing through said first catalytic cell to return from said intermediate chamber to said inlet chamber for recirculation through said first catalytic cell.

18. Improved emission control apparatus as set forth in claim 17 in which a transverse wall surrounds said first catalytic cell providing a dividing wall between said inlet chamber and said intermediate chamber, said return means comprising one or more ports through said dividing wall.

19. Improved emission control apparatus as set forth in claim 18 in which said return means comprises one or more silencing tubes one end of which is connected to one of said ports and the opposite end of which opens into said inlet chamber.

20. Improved emission control apparatus as set forth in claim 19 in which said housing includes an outlet chamber downstream of said another chamber and separated therefrom by a dividing wall, said another chamber and said outlet chamber being in fluid communication through one or more baffle tubes projecting through said dividing wall.

21. Improved emission control apparatus as set forth in claim 20 in which the walls of said silencing tubes and the walls of said baffle tubes are perforated by a plurality of holes to reduce noise emitted from said engine.

22. Improved emission control apparatus as set forth in claim 17 in which said housing includes an outlet chamber downstream of said another chamber and separated therefrom by a dividing wall, said another chamber and said outlet chamber being in fluid communication through one or more baffle tubes passing through said dividing wall, the walls of said baffle tubes being perforated by a plurality of holes to reduce noise emitted from said engine.

23. Improved emission control apparatus as set forth in claim 22 including an outlet tube connected to said housing outlet and projecting therefrom into said outlet chamber through which all gases are discharged from said housing, the walls of said outlet tube being perforated by a plurality of holes to further reduce noise emitted from said engine.

24. Improved emission control apparatus as set forth in claim 22 including an inlet tube connected to said housing inlet and projecting therefrom into said inlet chamber and through which all of said enhaust gases enter said housing, the walls of said inlet tube being perforated by a plurality of holes to further reduce noise emitted from said engine.

25. Improved emission control apparatus as set forth in claim 17 in which the cross-sectional flow area of said second catalytic cell is not substantially greater than the cross-sectional flow area of said first catalytic cell.

26. Improved emission control apparatus as set forth in claim 25 in which the cross-sectional flow area of said return means is less than the cross-sectional flow area of said first catalytic cell.

27. Improved emission control apparatus as set forth in claim 25 in which said housing is cylindrical and each of said catalytic cells is circular in cross-section, each of said catalytic cells being surrounded by an annular wall defining opposite ends of said intermediate chamber, the wall surrounding said first catalytic cell having ports therethrough providing said return means.

* * * * *